US010334931B2

(12) United States Patent
Kim

(10) Patent No.: US 10,334,931 B2
(45) Date of Patent: Jul. 2, 2019

(54) PUFF-EMBEDDED COSMETIC POWDER CONTAINER

(71) Applicants: CTK CO., LTD, Seongnam-si, Gyeonggi-do (KR); Jin Woo Kim, Anyang-si, Gyeonggi-do (KR)

(72) Inventor: Jin Woo Kim, Anyang-si (KR)

(73) Assignee: CTK CO. LTD., Seongnam-si, Gyeonggi-Do (KR)

( * ) Notice: Subject to any disclaimer, the term of this patent is extended or adjusted under 35 U.S.C. 154(b) by 325 days.

(21) Appl. No.: 15/121,006

(22) PCT Filed: Jan. 12, 2015

(86) PCT No.: PCT/KR2015/000292
§ 371 (c)(1),
(2) Date: Aug. 23, 2016

(87) PCT Pub. No.: WO2015/133722
PCT Pub. Date: Sep. 11, 2015

(65) Prior Publication Data

US 2017/0006996 A1 Jan. 12, 2017

(30) Foreign Application Priority Data

Mar. 5, 2014 (KR) ..... 10-2014-0025834

(51) Int. Cl.
*A45D 33/02* (2006.01)
*A45D 33/24* (2006.01)
(Continued)

(52) U.S. Cl.
CPC ..... *A45D 33/24* (2013.01); *A45D 33/008* (2013.01); *A45D 33/025* (2013.01); *A45D 40/221* (2013.01)

(58) Field of Classification Search
CPC .... A45D 33/24; A45D 33/008; A45D 33/025; A45D 40/221
See application file for complete search history.

(56) References Cited

U.S. PATENT DOCUMENTS 5,320,116 A * 6/1994 Ackermann ..... A45C 13/1084 132/293
5,896,866 A * 4/1999 Quennessen ..... A45C 13/008 132/293
(Continued)

FOREIGN PATENT DOCUMENTS

JP 2011-239971 A 12/2011
KR 10-0712934 B1 5/2007
(Continued)

*Primary Examiner* — Nicholas D Lucchesi
(74) *Attorney, Agent, or Firm* — John K. Park; Park Law Firm

(57) ABSTRACT

Disclosed herein is a puff-embedded cosmetic powder container including: a main body, a shoulder cap, a puff receiving cap, and an upper cap. A sealing step is formed on an inner circumference in a space of the main body, and a sealing wing is formed on an outer circumference of a sidewall of the shoulder cap to correspond to the sealing step, so that the sealing wing is elastically and airtightly coupled to the sealing step, and a rotary portion included in a hinge unit of the puff receiving cap has a movable space in which an end of a pin is movable up and down, so that, when the upper cap is closed, the puff receiving cap is pressed down via the movable space, thus sealing a powder discharge hole of the shoulder cap.

7 Claims, 6 Drawing Sheets

(51) Int. Cl.
*A45D 33/00* (2006.01)
*A45D 40/22* (2006.01)

(56) References Cited

U.S. PATENT DOCUMENTS 6,336,460 B2 * 1/2002 Yuhara ..... A45C 13/008 132/295
6,354,308 B1 * 3/2002 Kuk ..... A45C 13/008 132/293
6,923,335 B2 * 8/2005 Fujita ..... B65D 50/061 132/293
6,945,403 B2 * 9/2005 Lombardi ..... A45D 33/003 132/306
7,464,820 B2 * 12/2008 Oh ..... A45D 33/008 132/293
7,832,564 B2 * 11/2010 Kim ..... A45D 33/008 132/293
8,678,222 B2 * 3/2014 Thorpe ..... A45C 13/008 132/293
8,789,540 B2 * 7/2014 Lee ..... A45C 13/008 132/293
9,386,836 B2 * 7/2016 Lee ..... A45D 33/006
9,795,202 B1 * 10/2017 Zhang ..... A45D 33/003
9,930,952 B2 * 4/2018 Kim ..... A45D 33/006
2009/0272399 A1 * 11/2009 Kim ..... A45D 33/008 132/293
2011/0048442 A1 * 3/2011 Pires ..... A45D 33/003 132/200
2013/0087165 A1 * 4/2013 Lee ..... A45C 13/008 132/286
2015/0027487 A1 * 1/2015 Apodaca ..... A45D 33/006 132/307
2015/0320174 A1 * 11/2015 Kim ..... A45D 33/006 132/295
2017/0065057 A1 * 3/2017 Lee ..... A45D 33/24

FOREIGN PATENT DOCUMENTS

KR 10-1073436 B1 10/2011
KR 10-1305758 B1 9/2013

* cited by examiner

[Fig. 1]
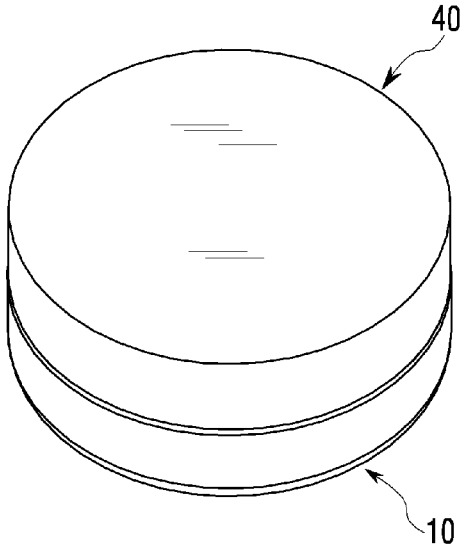

[Fig. 2]
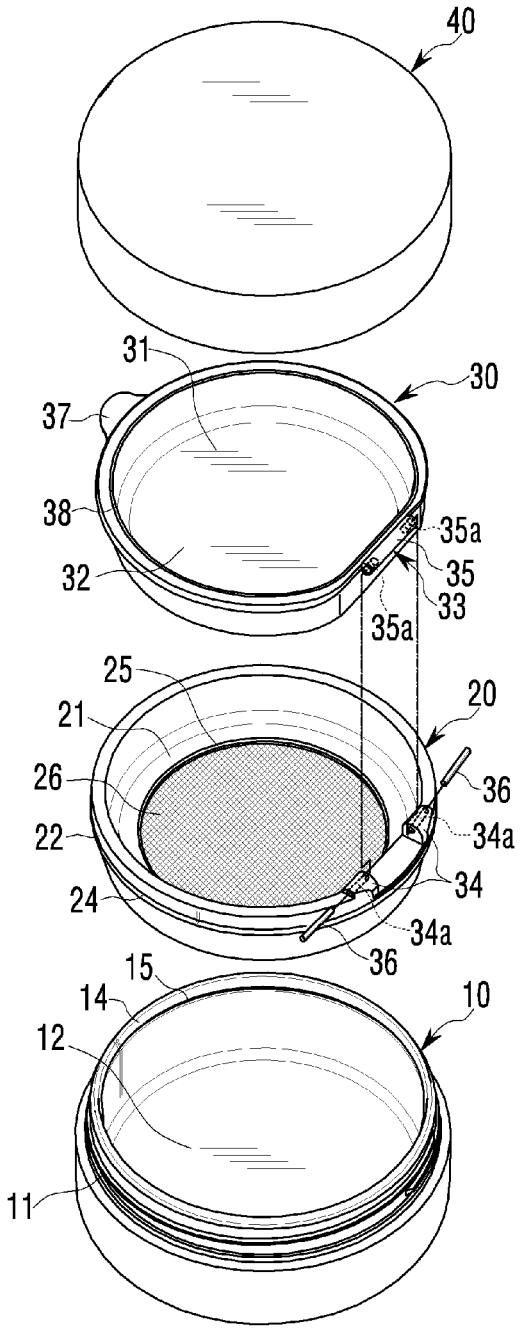

[Fig. 3]
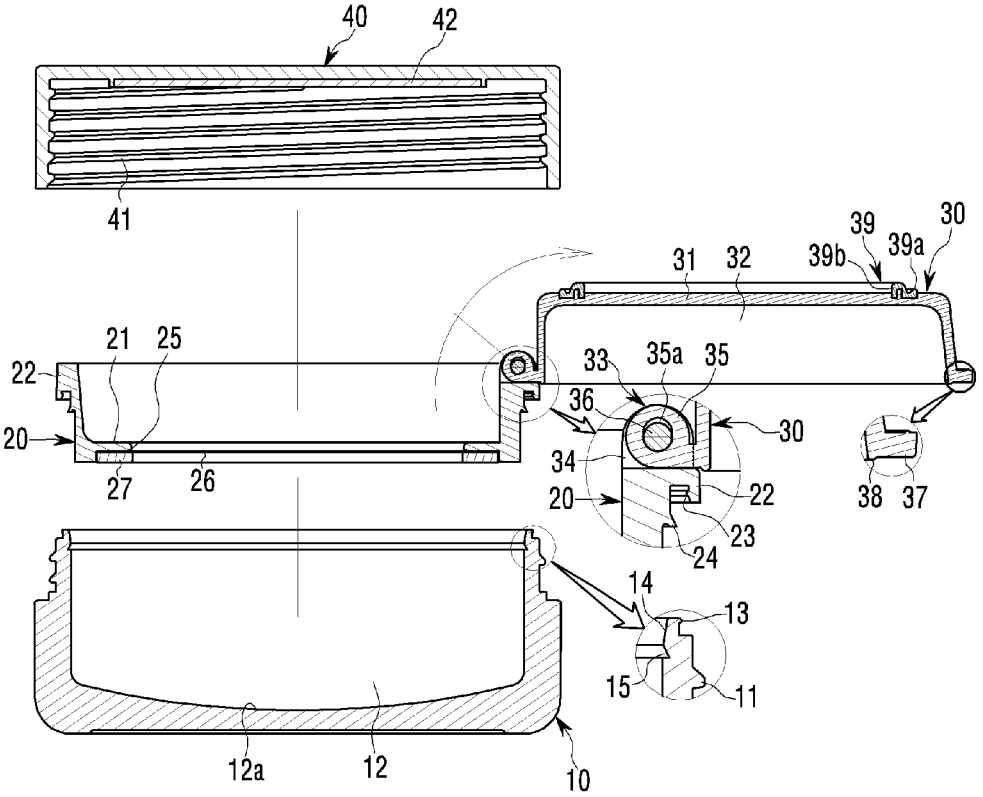
[Fig. 4]
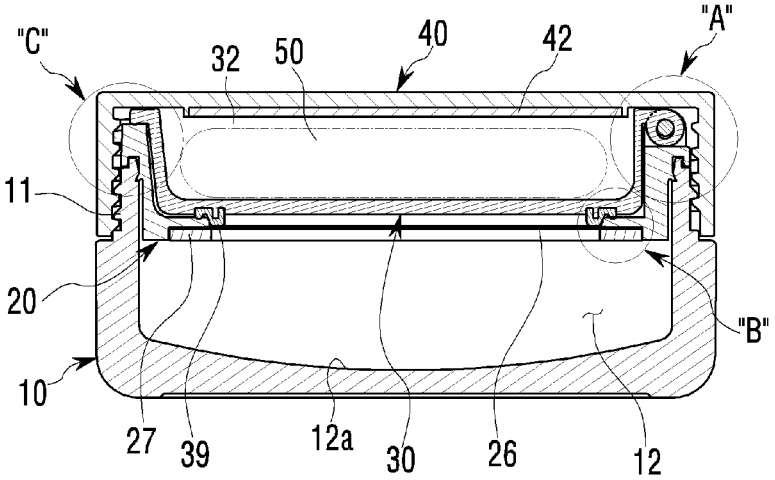

[Fig. 5]
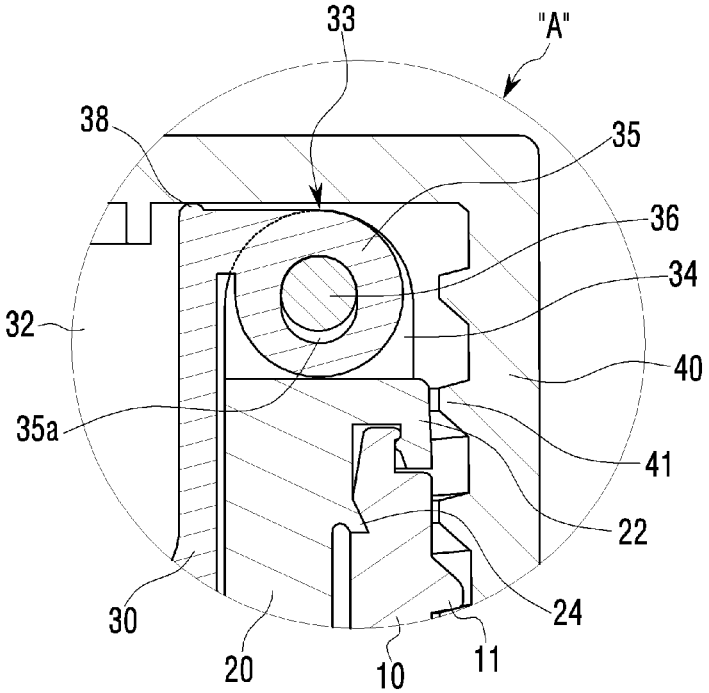
[Fig. 6]
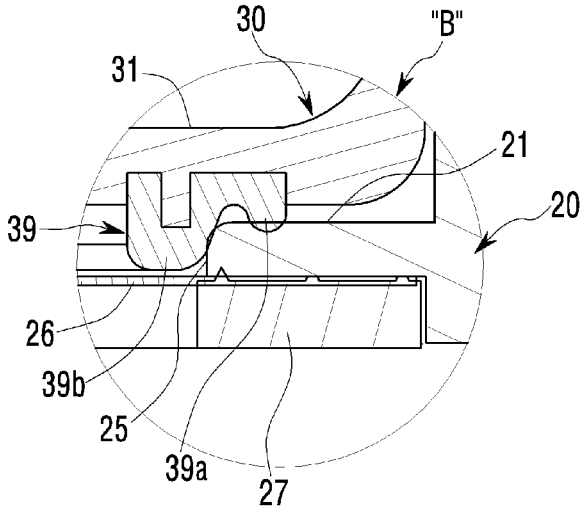

[Fig. 7]
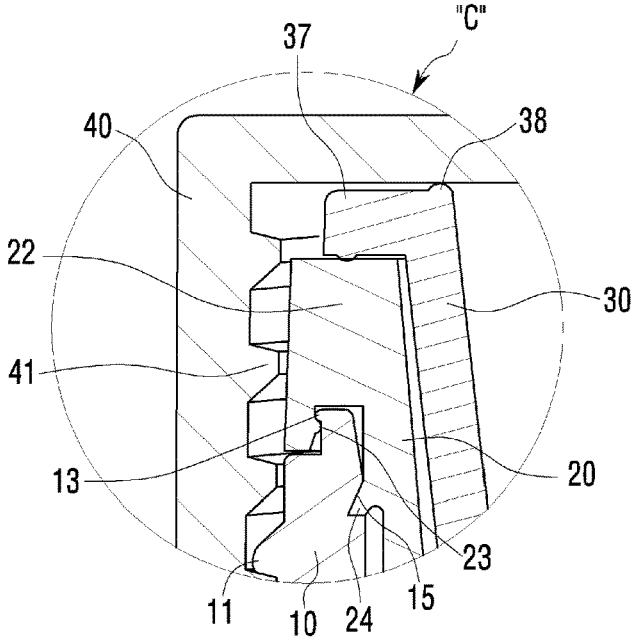
[Fig. 8]
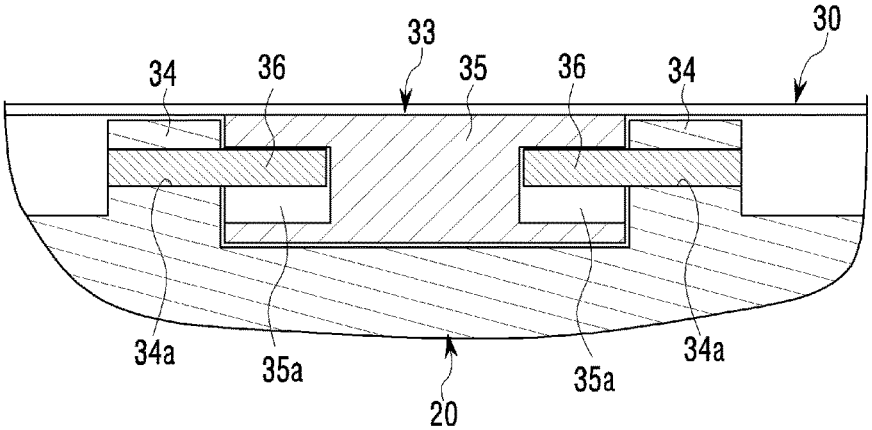
[Fig. 9]
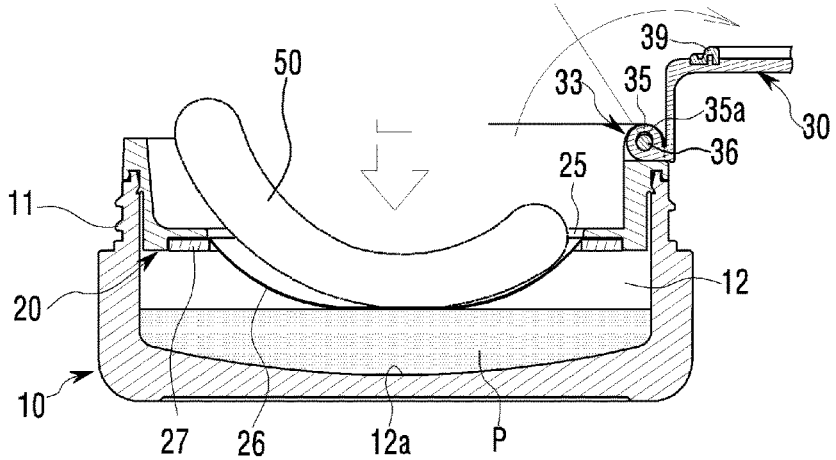

[Fig. 10]
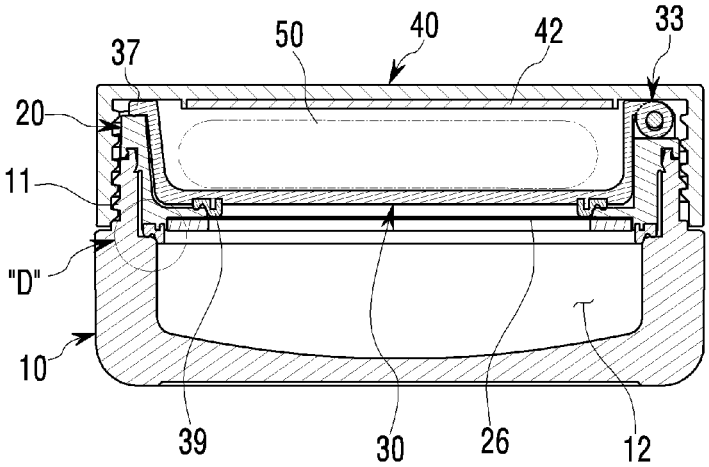
[Fig. 11]
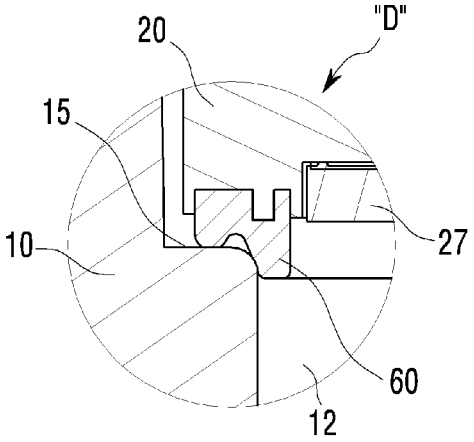

PUFF-EMBEDDED COSMETIC POWDER CONTAINER

TECHNICAL FIELD

The present invention relates, in general, to a puff-embedded cosmetic powder container which is configured to apply makeup by pressing a net provided on a shoulder cap with a puff and, more particularly, to a puff-embedded cosmetic powder container which is configured to provide excellent airtightness and marketability.

BACKGROUND ART

Generally, powder type cosmetics containing powder or liquefied powder are held in a powder container.

Such a conventional powder container includes a main body that holds powder or liquefied powder in an internal space thereof, and an upper cap that is coupled to an upper coupling portion of the main body in a thread-type fastening method. Contents held in the powder container are used by opening the upper cap, applying the powder to a makeup tool such as a brush or a puff and then dabbing or rubbing the powder with the makeup tool.

However, the conventional powder container is problematic in that the powder is directly applied to the makeup tool when in use, so that the powder may be undesirably applied to the makeup tool in a mass form, thus causing inconvenience to a user.

In order to solve the problem, as the related art, Korean U.M. Laid-open Publication No. 20-1999-00077 was proposed, which is configured such that a shoulder cap equipped with a net having an elastic force is seated in a central hole in an upper portion of the main body. Thus, when a user desires to apply the powder to the makeup tool, the makeup tool is not in direct contact with the powder but the net is elastically pressed. Such a configuration prevents the powder from being applied in mass form due to the net, and in addition, allows the powder to be evenly applied and effectively used.

However, the above-mentioned related art is problematic in that the central hole of the shoulder cap coupled to the upper portion of the main body is formed in a net shape, so that the powder may leak out through the net and thereby may be lost, and the space in the container carrying the cosmetics may be contaminated with the powder. Moreover, in the case that the powder is liquefied, airtightness is not ensured and the powder may be easily spoiled.

In order to solve the problem, Korean Patent No. 10-1073436 was filed by the applicant of the invention, which is entitled "Cosmetic Powder Container". The container is configured such that an airtight sealing member is coupled to a lower surface of the upper cap to airtightly seal the net of the shoulder cap.

However, the related art is problematic in that its application is limited to a configuration wherein the makeup tool, such as the puff, is not received in the powder container.

That is, this conventional container is problematic in that it is difficult to ensure airtightness for the net of the shoulder cap when a puff receiving cap is seated in an upper portion of a shoulder cap having a net as in Korean U.M. Registration No. 20-322309, so that the powder may leak out through the net and thereby may be lost, and the space in the container carrying the cosmetics may be contaminated with the powder, and airtightness is not ensured and the powder may be easily spoiled when the powder is liquefied.

DISCLOSURE

Technical Problem

Accordingly, the present invention has been made keeping in mind the above problems occurring in the related art, and is intended to provide a puff-embedded cosmetic powder container, which is configured such that a shoulder cap equipped with a net is airtightly coupled to an upper portion of a main body via a sealing wing, and a puff receiving cap having a puff, provided in an upper portion of the shoulder cap, is artificially pressed when an upper cap is fastened in a thread-type fastening method, and thereby an annular packing airtightly seals a powder discharge hole provided in the net of the shoulder cap, thus ensuring excellent airtightness when the cosmetic powder is carried and used and thereby preventing the cosmetic powder from leaking or escaping out, and further maintaining quality for a lengthy period of time due to the prevention of moisture evaporation.

Technical Solution

In an aspect, the present invention provides a puff-embedded cosmetic powder container, including a main body having a space to hold cosmetic powder therein; a shoulder cap including a coupling portion through which the shoulder cap is coupled to an upper end of the main body, and a net which is secured by a coupling ring to a powder discharge hole defined in a bottom portion thereof; a puff receiving cap including on a first side thereof a hinge unit to open or close the puff receiving cap relative to the shoulder cap, a receiving portion receiving a puff therein, and an annular packing provided on a lower portion of the bottom portion to block the powder discharge hole; and an upper cap coupled to the main body in a thread-type fastening method to open or close the main body, and pressurizing the puff receiving cap when the upper cap is coupled to the main body in the thread-type fastening method, thus allowing the annular packing provided on a lower portion of the puff receiving cap to forcibly seal the powder discharge hole of the shoulder cap, wherein a sealing step is formed on an inner circumference in the space of the main body, and a sealing wing is formed on an outer circumference of a sidewall of the shoulder cap to correspond to the sealing step, so that the sealing wing is elastically and airtightly coupled to the sealing step, and a rotary portion included in the hinge unit of the puff receiving cap has a movable space in which a second end of a pin is movable up and down, a first end of the pin being press-fitted into a pin fixing portion of the shoulder cap, so that, when the upper cap is manipulated to be closed, the puff receiving cap is pressed down via the movable space, thus sealing the powder discharge hole of the shoulder cap.

The puff-embedded cosmetic powder container may further include a sloped guide surface provided on an inner circumference of the upper end of the main body in such a way as to be connected to the sealing step, thus allowing the sealing wing to easily enter the main body when the shoulder cap is assembled with the main body.

The annular packing may include an upper-surface pressurizing portion serving to pressurize an upper surface of the bottom portion of the shoulder cap, and a side-surface pressurizing portion serving to pressurize an inner portion of the powder discharge hole.

The puff-embedded cosmetic powder container may further include a pressurizing protrusion formed on an upper surface of the puff receiving cap to allow the puff receiving cap to be evenly pressurized when the upper cap is coupled in the thread-type fastening method.

Locking steps may be provided on an outer portion of the upper end of the main body and an inner circumference of the coupling portion of the shoulder cap, respectively, to mate with each other, thus preventing undesirable removal.

Each of the sealing step provided on the main body and the sealing wing provided on the shoulder cap may be formed to be enlarged at a lower end thereof.

The puff-embedded cosmetic powder container may further include a step portion formed on an inner edge of the main body, wherein an annular packing coupled to a circumference of a lower end of the shoulder cap may be in close contact with the step portion, thus realizing a double airtight sealing structure.

Advantageous Effects

As described above, the puff-embedded cosmetic powder container according to the present invention is advantageous in that the gap between the main body and the shoulder cap coupled to the upper portion thereof is airtightly sealed by the sealing step and the sealing wing, and the powder discharge hole formed in the shoulder cap is airtightly sealed because, when the upper cap is coupled in the thread-type fastening method, the puff receiving cap is forcibly pressed down through the hinge unit and thereby the shoulder cap is elastically urged by the annular packing provided in the puff receiving cap, so that there is no possibility that the cosmetic powder leaks or escapes out of the space of the main body, and the evaporation of the moisture contained in the powder is also prevented, thus preventing the product from spoiling and allowing the product to be hygienically used and carried.

Further, the puff-embedded cosmetic powder container according to the present invention is advantageous in that the step portion of the main body and the annular packing airtightly coupled thereto cause the cosmetic powder held in the space of the main body to be doubly airtightly sealed by both the sealing step and the sealing wing, thus achieving more excellent sealing effect.

DESCRIPTION OF DRAWINGS

FIG. 1 is a perspective view showing an appearance of a powder container according to the present invention;

FIG. 2 is an exploded perspective view showing the powder container according to the present invention;

FIG. 3 is an exploded sectional view showing the powder container according to the present invention;

FIG. 4 is a sectional view showing the assembled powder container according to the present invention;

FIG. 5 is an enlarged view showing portion "A" encircled in FIG. 4;

FIG. 6 is an enlarged view showing portion "B" encircled in FIG. 4;

FIG. 7 is an enlarged view showing portion "C" encircled in FIG. 4;

FIG. 8 is an extracted sectional view showing an assembly structure of a pin in a hinge unit of the present invention;

FIG. 9 is a sectional view showing a state where cosmetic powder of the present invention is applied to a puff to be used;

FIG. 10 is a sectional view showing an assembled powder container according to another embodiment of the present invention; and FIG. 11 is an enlarged view showing portion "D" encircled in FIG. 10.

MODE FOR INVENTION

Hereinbelow, preferred embodiments of the present invention will be described in detail with reference to the accompanying drawings.

As shown in FIGS. 1 to 8, a puff-embedded cosmetic powder container according to the present invention mainly includes a main body 10, a shoulder cap 20, a puff receiving cap 30, and an upper cap 40.

The main body 10 is open at one end thereof, and has a space 12 of a predetermined depth. An inner bottom surface 12*a* of the space 12 is curved to converge on a center thereof. A cosmetic powder or a liquefied cosmetic powder, which is hereinafter referred to as the 'cosmetic powder', is held in the space. Further, an external threaded portion 11 is formed on an outer circumference of an upper end in the space 12 to be used for a thread-type fastening method. Further, a locking step 13 is formed on the outer circumference of the upper end in the space 12 to be used for the step coupling, while a sloped guide surface 14 is formed on an inner circumference of the upper end in the space 12 in such a way as to be tapered downwards. Further, a sealing step 15 is formed on the inner circumference of the upper end in the space 12 to be used for sealed coupling.

The shoulder cap 20 is coupled to the main body 10 in such a way that its bottom portion 21 is accommodated in the main body 10. A coupling portion 22 is provided on an upper end of the shoulder cap 20 to be fitted into the upper end of the main body 10. A locking step 23 is correspondingly formed on the coupling portion 22 to mate with the locking step 13 of the main body 10. Further, a sealing wing 24 is formed on an outer circumference of a lower end of the coupling portion 22 to be elastically and airtightly coupled to the sealing step 15 formed on the inner circumference in the space 12 of the main body 10. The sealing wing 24 has a shape corresponding to that of the sealing step 15. Preferably, each of the sealing step 15 and the sealing wing 24 may be formed to be enlarged at a lower end thereof, thus facilitating tension coupling and airtight sealing.

Further, a powder discharge hole 25 is formed in the bottom portion 21 of the shoulder cap 20 that is accommodated in the space 12 when the shoulder cap 20 is coupled with the main body 10. The powder discharge hole 25 is covered by a flexible net 26, and an edge of the net 26 is secured by a coupling ring 27 to prevent the undesirable removal of the net 26. The coupling ring 27 is commonly secured to a lower portion of the bottom portion 21 of the shoulder cap 20 to be integrated therewith by an ultrasonic bonding method, thus allowing the net 26 to be always safely supported while maintaining a tension force even if the net 26 is pressed down.

The puff receiving cap 30 is seated in the shoulder cap 20 to be open or closed via a hinge unit 33 that is provided on a side of the puff receiving cap 30, while a bottom portion 31 is accommodated in the shoulder cap 20, and is provided with a receiving portion 32 to receive a puff 50 therein. The hinge unit 33 includes pin fixing portions 34 that are provided on a side of the shoulder cap 20 in such a way as to be separately located on both sides thereof, and a rotary portion 35 that is provided on a side of the puff receiving cap 30 in such a way as to be interposed between the pin fixing portions 34. Pin fixing holes 34*a* are coaxially formed through the pin fixing portions 34 in such a way that one end of a pin 36 is press-fitted into each of the pin fixing holes 34*a*. The rotary portion has a movable space 35*a* into which the other end of the pin fitted into the pin fixing hole 34*a* of each pin fixing portion 34 is loosely fitted. Further, a handle 37 is provided on a side opposite to the hinge unit 33, and a pressurizing protrusion 38 is provided on an upper surface of the puff receiving cap 30.

Meanwhile, an annular packing 39 made of an elastic material, such as silicon rubber, is provided on a lower portion of the bottom portion 31 of the puff receiving cap 30 to seal the powder discharge hole 25 of the shoulder cap 20. Preferably, the annular packing 39 is integrally formed by a general insert molding method. However, the annular packing 39 may be separately made and then assembled if necessary.

The annular packing 39 includes an upper-surface pressurizing portion 39*a* that serves to pressurize the upper surface of the bottom portion 21 in which the powder discharge hole 25 of the shoulder cap is formed, and a side-surface pressurizing portion 39*b* that serves to pressurize the inner circumference of the powder discharge hole 25. Thereby, when the puff receiving cap 30 is manipulated to be closed, the powder discharge hole 25 of the shoulder cap 20 is preferably airtightly sealed in at least two places, thus preventing the cosmetic powder from leaking or escaping out of the main body through the powder discharge hole 25.

The upper cap 40 is operated as follows: when a user desired to carry or store the powder container, an internal threaded portion 41 formed on an inner circumference of the upper cap 40 engages with the external threaded portion 11 formed on the outer circumference of the upper end of the main body 10 to close the upper cap 40, whereas, when the user desires to put on makeup using the cosmetic powder, the internal threaded portion 41 disengages from the external threaded portion 11 to open the upper cap 40. A mirror 42 is attached to an inner surface of the upper cap 40 to allow a user to check makeup with the cosmetic container in one hand when the user puts on powder makeup. Further, the upper cap 40 also serves to pressurize the puff receiving cap 30 when the upper cap 40 is closed.

The cosmetic-powder receiving operation and assembly of the puff-embedded cosmetic powder container according to the present invention configured as described above will be described with reference to FIGS. 3 to 8.

First, after the cosmetic powder P is received in the space 12 of the main body 10, the shoulder cap 20 is airtightly coupled to the upper portion of the main body 10. To be more specific, after the shoulder cap 20 is positioned above the space 12 of the main body 10 and the coupling portion 22 of the shoulder cap 20 is aligned with the upper end of the main body 10, the shoulder cap 20 is pressed to be fitted into the main body 10. Then, the coupling portion 22 of the shoulder cap 20 is fitted into the upper end of the main body 10. Further, during the coupling of the shoulder cap 20, the sealing wing 24 formed on the outer circumference of a sidewall of the shoulder cap 20 rides down the sloped guide surface 14 formed on the inner circumference of the upper end of the space 12 in the main body 10 to be compressed inwards. The reason is because an outer radius of the sealing wing 24 is larger than an inner radius of the sloped guide surface 14. Further, the sealing wing 24 riding down the sloped guide surface 14 while being compressed inwards reaches the sealing step 15 that is correspondingly formed on the inner circumference of the space 12 in the main body 10. At this time, the sealing wing 24 returns to its original state by the elastic force of the sealing wing 24 itself. Simultaneously, the sealing wing 24 is elastically and airtightly coupled to the sealing step 15, so that the main body 10 and the shoulder cap 20 are primarily airtightly coupled to each other.

Thus, the sealing wing 24 provided on the shoulder cap 20 and the sealing step 15 correspondingly formed on the inner circumference in the space 12 of the main body 10 are airtightly coupled to each other, thus preventing the cosmetic powder P held in the space 12 from leaking or escaping out through the upper end in the space 12 of the main body 10. Further, the undesirable removal of the shoulder cap 20 is prevented as the locking step 23 provided on the coupling portion 22 elastically mates with the locking step 13 formed on the upper end of the main body 10, thus ensuring the stable coupling of the shoulder cap 20

In such a state, if the puff receiving cap 30 is positioned in the shoulder cap 20, the powder discharge hole 25 of the shoulder cap 20 is preliminarily blocked by the annular packing 39 provided on the lower surface of the bottom portion 31. That is, when the puff receiving cap 30 is simply rotated using the hinge unit 33 so that the bottom portion 31 is positioned in the shoulder cap 20, the puff receiving cap 30 is coupled to the shoulder cap 20 but does not strongly come into close contact with the shoulder cap 20. Therefore, the powder discharge hole 25 maintains a contact state with the upper surface of the bottom portion 21 and the side surface of the inner circumference of the powder discharge hole 25 by means of the upper-surface pressurizing portion 39*a* and the side-surface pressurizing portion 39*b* of the annular packing 39 provided on the lower portion of the bottom portion 21.

In such a state, finally, if the internal threaded portion 41 of the upper cap 40 engages with the external threaded portion 11 formed on the upper end of the main body 10, the puff receiving cap 30 is completely tightened on the main body 10 by the coupling force of the upper cap. At this time, the pressurizing protrusion 38 formed on the upper surface of the puff receiving cap 30 comes into contact with the inner circumference of the upper cap 40 to be evenly pressurized. Thus, as the pressurizing protrusion 38 is forcibly pressurized, the puff receiving cap 30 moves downwards by a pressurized distance. Such a pressurizing action causes the annular packing 39 formed on the lower portion of the bottom portion 31 of the puff receiving cap 30 to be subjected to a strong pressurizing force due to the properties of the elastic material. Thereby, the upper surface of the shoulder cap 20 having the powder discharge hole 25 is pressurized by the upper-surface pressurizing portion 39*a*, and simultaneously the side surface of the powder discharge hole 25 is pressurized by the side-surface pressurizing portion 39*b*. Accordingly, the powder discharge hole 25 formed in the shoulder cap 20 is blocked due to the pressurizing force of the annular packing 39, thus preventing the leakage or escape of the cosmetic powder P held in the space 12 of the main body 10.

Meanwhile, during the pressurizing of the puff receiving cap 30, the puff receiving cap 30 is safely moved down and pressurized while preventing the pin 36 from being removed from the movable space 35*a* defined in the rotary portion 35 of the hinge unit 33, as shown in FIG. 8. If the pressurizing force is released, the puff receiving cap 30 is moved up again by the movement of the pin 36 within the movable space 35*a* due to the elastic restoring force of the annular packing 39.

Further, the puff receiving cap 30 is joined to the shoulder cap 20 via the hinge unit 33 provided on a side of the puff receiving cap 30, so that unexpected removal or loss never occurs.

Therefore, the puff-embedded cosmetic powder container according to the present invention assembled in this manner is used as follows. The cosmetic powder P held in the space 12 of the main body 10 is sealed as the sealing wing 24 of the shoulder cap 20 is coupled to the sealing step 15 formed on the inner circumference in the space 12 of the main body 10 under tension. Simultaneously, as the upper cap 40 is fastened to the main body 10 in the thread-type fastening method, the puff receiving cap 30 is forcibly pressed, so that the annular packing 39 provided on the lower portion of the bottom portion 31 blocks the powder discharge hole 25 of the shoulder cap 20. Such a configuration prevents the leakage or escape of the cosmetic powder through the upper surface of the main body 10 or the powder discharge hole 25 of the shoulder cap 20. For this reason, it is possible to hygienically carry and use the cosmetic powder while preventing its loss.

Meanwhile, when a user desires to use the cosmetic powder P held in the main body 10 in such a state, as shown in FIG. 9, the upper cap 40 is removed from the main body 10 and then the puff 50 is taken out from the puff receiving cap 30. Subsequently, the puff receiving cap 30 is rotated about the hinge unit 33 using the opening handle 37 to be opened relative to the shoulder cap 20. The user holds the puff 50 in one hand and presses the net 26 provided in the powder discharge hole 25 of the shoulder cap 20 to apply a proper amount of cosmetic powder P held in the space 12 of the main body 10. Since the net 26 pressed by the puff P is made of a flexible material, the net 26 has an elastic force sufficient to reach the bottom surface in the space 12 of the main body 10. Further, the net 26 is fixed by the coupling ring 27, thus preventing the net 26 from being torn or removed and allowing the user to smoothly use the cosmetic powder without any difficulty.

The puff-embedded cosmetic powder container according to the present invention may be configured as shown in FIGS. 10 and 11. That is, a step portion 15 may be formed in the space 12 of the main body 10 in such a way as to protrude out, and an annular packing 60 provided on a circumference of the lower portion of the bottom portion 21 of the shoulder cap 20 may be secondarily in close contact with the step portion 15. Other components that are not described herein are identical to those illustrated in FIGS. 1 to 9.

The step portion 15 and the annular packing 60 realize secondary airtight coupling, thus more efficiently sealing a gap between the main body 10 and the shoulder cap 20 and considerably preventing the cosmetic powder held in the space 12 of the main body 10 from leaking or escaping out, in addition to reliably preventing the moisture from evaporating in the case of the liquefied cosmetic powder therein.

Although the embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A puff-embedded cosmetic powder container, comprising:

a main body having a space to hold cosmetic powder therein;

a shoulder cap including a coupling portion through which the shoulder cap is coupled to an upper end of the main body, and a net which is secured by a coupling ring to a powder discharge hole defined in a bottom portion thereof;

a puff receiving cap including on a first side thereof a hinge unit to open or close the puff receiving cap relative to the shoulder cap, a receiving portion receiving a puff therein, and an annular packing provided on a lower portion of the bottom portion to block the powder discharge hole; and an upper cap coupled to the main body in a threaded fastening method to open or close the main body, and pressurizing the puff receiving cap when the upper cap is coupled to the main body in the threaded fastening method, thus allowing the annular packing provided on a lower portion of the puff receiving cap to forcibly seal the powder discharge hole of the shoulder cap, wherein a sealing step is formed on an inner circumference in the space of the main body, and a sealing wing is formed on an outer circumference of a sidewall of the shoulder cap to correspond to the sealing step, so that the sealing wing is elastically and airtightly coupled to the sealing step when the shoulder cap is coupled to the main body, and a rotary portion included in the hinge unit of the puff receiving cap has a movable space in which a second end of a pin is movable up and down, a first end of the pin being press-fitted into a pin fixing portion of the shoulder cap, so that, when the upper cap is manipulated to be closed, the puff receiving cap is pressed down via the movable space, thus sealing the powder discharge hole of the shoulder cap.

2. The puff-embedded cosmetic powder container according to claim 1, further comprising:

a sloped guide surface provided on an inner circumference of the upper end of the main body in such a way as to be connected to the sealing step, thus allowing the sealing wing to easily enter the main body when the shoulder cap is assembled with the main body.

3. The puff-embedded cosmetic powder container according to claim 1, wherein the annular packing comprises an upper-surface pressurizing portion serving to pressurize an upper surface of the bottom portion of the shoulder cap, and a side-surface pressurizing portion serving to pressurize an inner portion of the powder discharge hole, so that the powder discharge hole is airtightly sealed in at least two places.

4. The puff-embedded cosmetic powder container according to claim 1, further comprising:

a pressurizing protrusion formed on an upper surface of the puff receiving cap to allow the puff receiving cap to be evenly pressurized when the upper cap is coupled in the threaded fastening method.

5. The puff-embedded cosmetic powder container according to claim 1, wherein locking steps are provided on an outer portion of the upper end of the main body and an inner circumference of the coupling portion of the shoulder cap, respectively, to mate with each other, thus preventing undesirable removal.

6. The puff-embedded cosmetic powder container according to claim 1, wherein each of the sealing step provided on the main body and the sealing wing provided on the shoulder cap is formed to be enlarged at a lower end thereof.

7. The puff-embedded cosmetic powder container according to claim 1, further comprising:

a step portion formed on an inner edge of the main body, wherein an annular packing coupled to a circumference of a lower end of the shoulder cap is in close contact with the step portion, thus forming a double airtight sealing structure.

* * * * *